United States Patent [19]

Hornsby

[11] 3,951,422

[45] Apr. 20, 1976

[54] SHOCK ABSORBER FOR SKATES

[76] Inventor: Guyton Ellis Hornsby, 2001 Rose Lane, Annandale, Va. 22003

[22] Filed: Mar. 12, 1975

[21] Appl. No.: 557,491

[52] U.S. Cl. ..... 280/11.28; 36/7.8

[51] Int. Cl.[2] ..... A63C 17/02

[58] Field of Search ..... 280/11.28, 11.27, 11.26, 280/11.19, 11.23, 11.22, 11.2, 11.25, 7.13, 11.1 R, 11.1 BT, 87.04 A

[56] References Cited

UNITED STATES PATENTS

| | | | |
|---|---|---|---|
| 282,156 | 7/1883 | Burton | 280/11.23 |
| 1,021,142 | 3/1912 | Freeman | 36/7.8 |
| 1,609,612 | 12/1926 | Eskeland | 280/11.22 |
| 1,609,966 | 12/1926 | Rohdiek | 280/11.26 |

*Primary Examiner*—M. H. Wood, Jr.
*Assistant Examiner*—Milton L. Smith
*Attorney, Agent, or Firm*—John B. Dickman, III.

[57] ABSTRACT

Roller skates are provided with a pneumatic shock absorbing system to cushion the skaters foot from wheel shock.

2 Claims, 4 Drawing Figures

SHOCK ABSORBER FOR SKATES

BACKGROUND OF THE INVENTION

1. Field of the Invention:

This invention relates in general to roller skates and more particularly to a pneumatic shock absorbing system to cushion the skater from wheel shock.

In most instances roller skates are assembled as a substantially rigid unit having no springs or shock absorbing means between the trucks and the sole plate. An effort to deal with this problem has resulted in making the truck wheels from materials having various degrees of resiliency. The unresolved drawback in this method is that in order to get a good shock absorbing material it is too soft to sustain its configuration.

Therefore just as the demand for improvement brought the wagon and motor vehicle, which started with their bodies attached directly to the wheel axle, to the smooth ride they deliver today, so should these improvements be desirable and available for roller skates.

2. Description of the Prior Art:

U.S. Pat. No. 1,609,966, Rohdiek, teaches the use of an inflated balloon contained in an open chamber under the skaters heel. However, the effectiveness of this is dependent on the fit of the skate to the back of the shoe counter and the front of the heel.

U.S. Pat. No. 1,021,142, Freeman, teaches the use of a pneumatic chamber combined with an internal spring attached to a shoe to act as a shock absorber when walking.

SUMMARY OF THE INVENTION

It is the primary object of this invention to provide a pneumatic shock absorbing system for use with roller skates which will function in all circumstances and cushion the foot of the skater from wheel shock.

Means to achieve the above and other objects, features and advantages of the present invention will become more apparent from the following description in reference to the accompanying drawings.

DESCRIPTION OF THE PREFERRED EMBODIMENT

Figure 1:
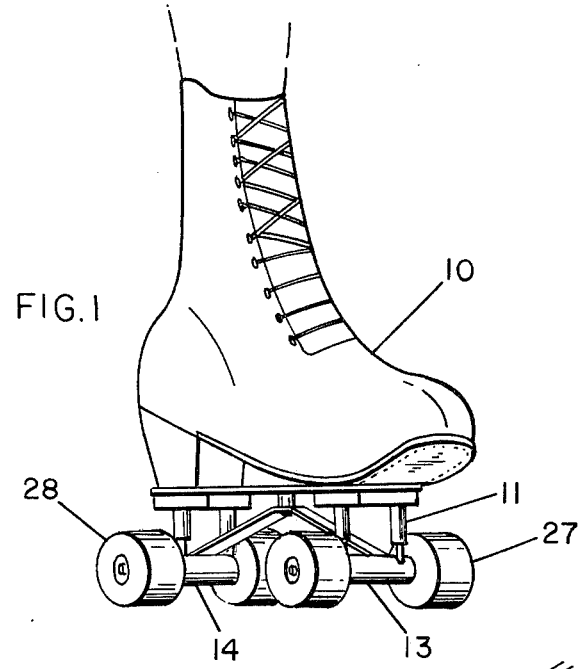
FIG. 1 is a view of the skate assembly.
Figure 2:
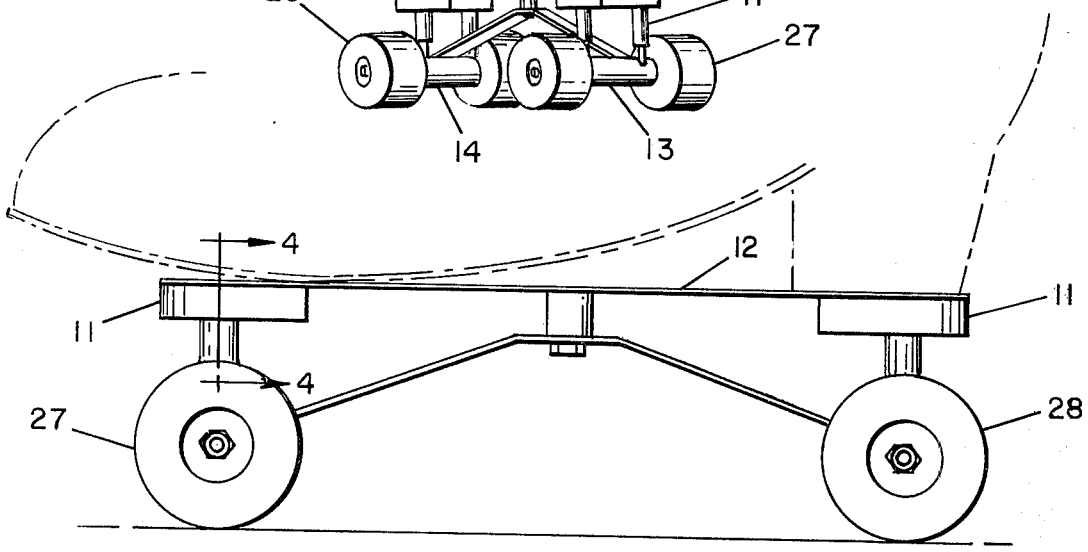
FIG. 2 is a side view of the skate.
Figure 3:
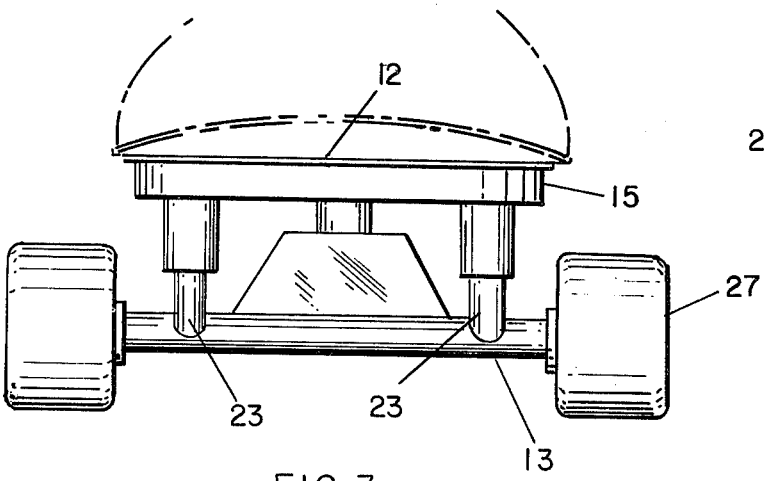
FIG. 3 is a front view of the skate.
Figure 4:
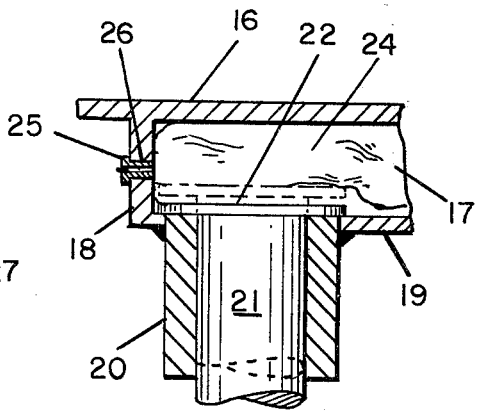
FIG. 4 is a section cut, taken along line 4—4 in FIG. 2.

A roller skate 10 has a pneumatic shock absorbing system 11 attached between the sole plate 12 and its forward truck axle 13 and its aft truck axle 14.

The pneumatic shock absorbing system 11 comprises a chamber 15 having a top 16, two sides 17, two ends 18 and a bottom 19. A pair of cylindrical hollow tubes 20 are attached to the bottom 19 and extend into the chamber 15 to form a guideway.

A piston 21 having an enlarged head 22 extending into the chamber 15 and a rod 23 is slidably engaged for reciprocation in each tube 20. The rods 23 are attached by suitable means such as welding to the truck axles 13 and 14.

An inflatable elastic air bag 24 made of suitable material such as rubber is contained in the chamber 15. The air bag 24 is configured substantially to the inside of the chamber 15 and has a filling valve 25 extending outwardly through an aperture 26 in the side 17 of the chamber 15.

In operation the air bag 24 is inflated to the desired pressure and when the skater goes over a rough surface the skate wheel trucks 27 and 28 move upward forcing the piston head 22 into the chamber 15 against the inflated air bag 24 where compression of the air therein absorbs the shock.

The amount of air pressure in the bag 24 determines the amount of piston movement and the air pressure may be bled from the bag 24 through the valve 25 to adjust to the skaters requirements.

As shown in FIG. 1, the skate has a permanently attached shoe but the shock absorber system 11 will function on any type skate.

The skate can also be applied to any shoe by the use of conventional attaching clamps, which are well known in the art.

I claim:

1. In combination with a roller skate having axles, a pneumatic shock absorber system comprising:

a. a chamber attached to the sole plate of said roller skate, said chamber having a top, two sides, two ends, and a bottom;

b. a plurality of hollwo cylindrical tubes attached at their upper ends to said bottom and extending into said chamber to form a guideway;

c. a piston having upper and lower ends slidably engaged for reciprocation in each said tube; and d. an inflatable elastic air bag contained in said chamber between the upper end of said piston and the top of said chamber, said air bag having a filler valve extending outwardly through an aperture in said side of said chamber, said lower ends of said pistons attached to said axles.

2. The combination described in claim 1 wherein said piston comprises a rod having an enlarged head, said rod is suitably attached to the wheel truck axle of said roller skate whereby upward movement of said wheel truck axle moves said piston rod upward in said tube forcing said piston head into said chamber to compress said inflated air bag thereby absorbing the shock transmitted by said skate wheel trucks.

* * * * *